United States Patent [19]

Johnson et al.

[11] 3,973,719

[45] Aug. 10, 1976

[54] CONTAINER HAVING A MEMBRANE-TYPE CLOSURE

[75] Inventors: Charles Louis Johnson; Charles Donald Stuard, both of Cincinnati, Ohio

[73] Assignee: The Procter & Gamble Company, Cincinnati, Ohio

[22] Filed: Apr. 7, 1975

[21] Appl. No.: 565,902

Related U.S. Application Data

[62] Division of Ser. No. 488,101, July 12, 1974, Pat. No. 3,892,351.

[52] U.S. Cl. ..... 229/5.6; 229/43; 220/257; 220/258; 220/308; 220/359; 53/39; 215/341

[51] Int. Cl.[2] ..... B65D 3/10

[58] Field of Search ..... 229/43, 48 T, 5.6; 220/359, 257, 258, 308; 53/39; 215/341, 317

[56] References Cited

UNITED STATES PATENTS

| | | | |
|---|---|---|---|
| 2,937,481 | 5/1960 | Palmer | 53/39 |
| 3,460,310 | 8/1969 | Adcock et al. | 53/39 |
| 3,471,992 | 10/1969 | Amberg et al. | 53/39 |
| 3,525,454 | 8/1970 | Frederiksen | 220/359 |
| 3,805,993 | 4/1974 | Enzie et al. | 220/308 |
| 3,844,439 | 10/1974 | Demers et al. | 215/344 |

*Primary Examiner*—George T. Hall
*Attorney, Agent, or Firm*—Thomas J. Slone; John V. Gorman; Richard C. Witte

[57] ABSTRACT

A container assembly is provided which comprises a composite tubular body having an outwardly rolled top rim which body has an asymmetrically tabbed membrane-type closure sealingly secured to the rolled rim so that the peripheral section of the closure conforms radially and circumferentially to an upwardly facing annular area of the rolled rim. The method of making the container subassembly comprises induction heat sealing membrane-type closure comprising an electrically conductive sheet to a composite tubular body comprising an electrically conductive liner with electrical insulation means and heat activatable sealant disposed therebetween. The method further comprises biasing the peripheral section of the closure towards the rolled rim with a uniformly distributed force while the induction heat sealing is being effected.

2 Claims, 19 Drawing Figures

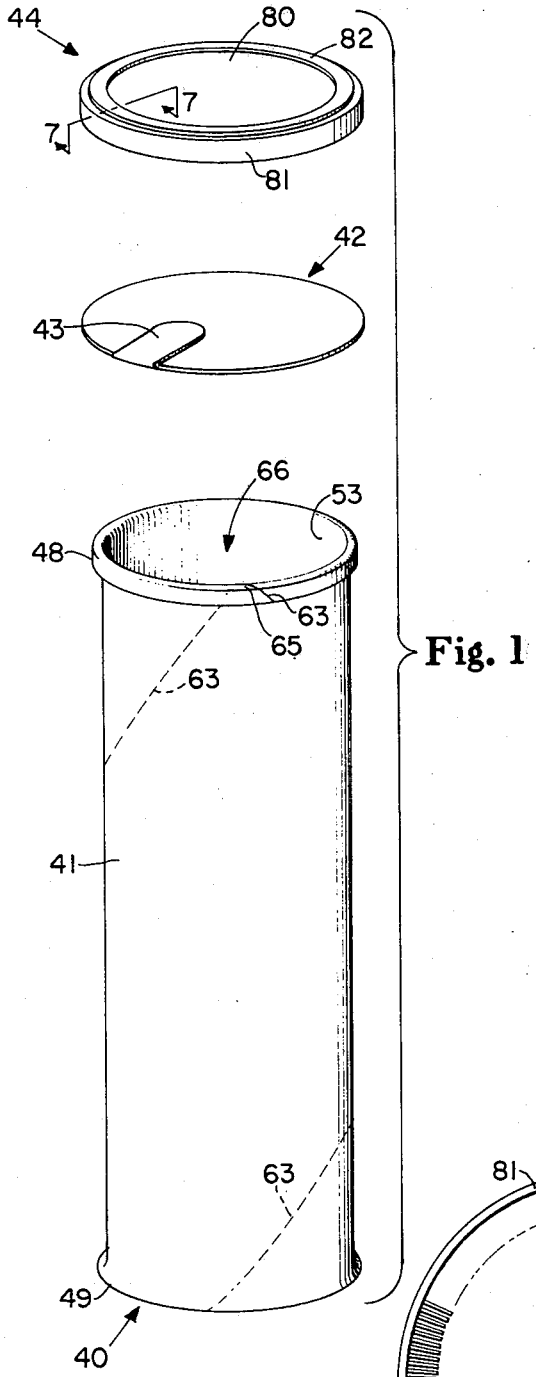
Fig. 1
Fig. 2
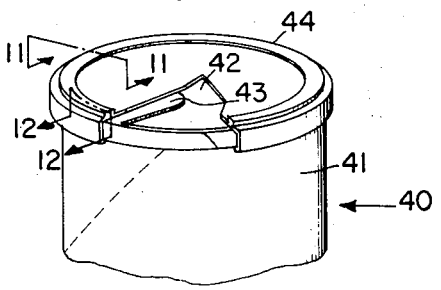
Fig. 3
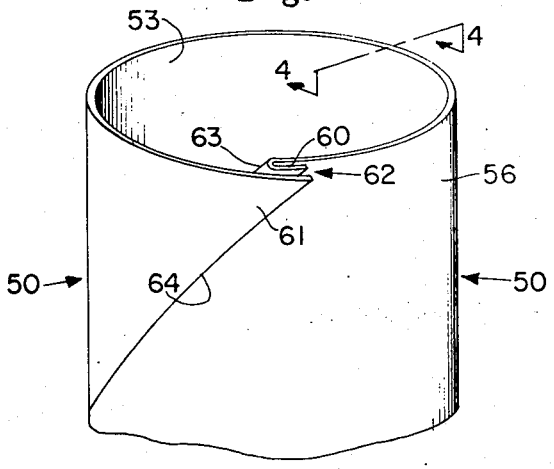
Fig. 5
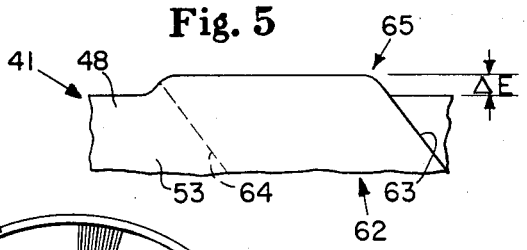
Fig. 6
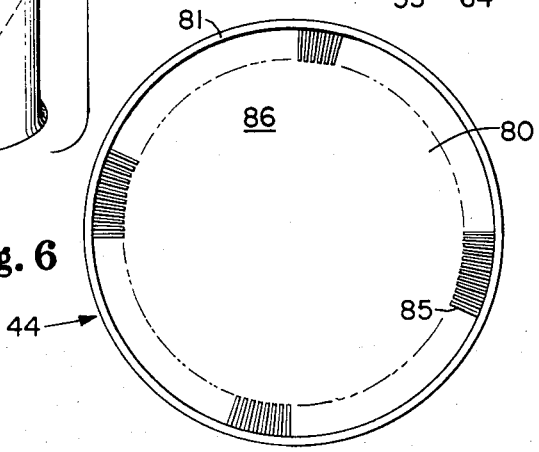
Fig. 4
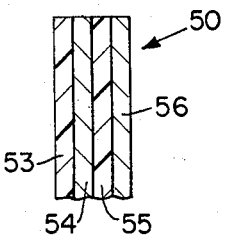

CONTAINER HAVING A MEMBRANE-TYPE CLOSURE

This is a division of application Ser. No. 488,101, filed July 12, 1974, now U.S. Pat. No. 3,892,351.

FIELD OF THE INVENTION

Providing containers comprising membrane-type closures having integral tabs which may be grasped to enable removal of the closure.

BACKGROUND OF THE INVENTION

Various aspects of providing containers having membrane-type closures, and of induction heat sealing membrane-type closures to containers are disclosed in prior art U.S patents of which the following are representative: U.S. Pat. No. 2,937,481 issued May 24, 1960 to Jack Palmer; U.S. Pat. No. 3,460,310 issued Aug. 12, 1969 to Edmund Philip Adcock et al.; U.S. Pat. No. 3,501,045 issued Mar. 17, 1970 to Richard W. Asmus et al.; U.S. Pat. No. 3,734,044 issued May 22, 1973 to Richard W. Asmus et al.; U.S. Pat. No. 3,767,076 issued Oct. 23, 1973 to Leo J. Kennedy; U.S. Pat. No. 3,805,993 issued Apr. 23, 1974 to William H. Enzie et al.; and U.S. Pat. No. 3,808,074 issued Apr. 30, 1974 to John Graham Smith et al. However, the prior art does not disclose solutions to all of the problems associated with providing containers having membrane-type closures in the manner of or degree of the present invention.

OBJECTS OF THE INVENTION

The nature and substance of the invention will be more readily appreciated after giving consideration to its major aims and purposes. The principal objects of the invention are recited in the ensuing paragraphs in order to provide a better appreciation of its important aspects prior to describing the details of a preferred embodiment in later portions of this description.

A major object of the present invention is providing a container subassembly comprising a composite tubular body and an asymmetrical shape membrane-type closure having an integral pull tab and means for induction heat sealing the closure to the body to effect a hermetic seal therebetween.

Another major object of the present invention is providing a hermetically sealable container subassembly comprising a spirally wound composite tubular body, and an asymmetrical shape membrane-type closure having an integral pull tab.

Still another major object of the present invention is providing the container subassembly described in the preceding paragraph which subassembly comprises means for being induction heat sealed.

Yet still another major object of the present invention is providing the container subassembly described in the preceding paragraph which container further comprises an overcap having heat-deformable means for causing the peripheral section of the closure to conform radially and circumferentially to a rolled rim of the tubular body.

Yet another major object of the present invention is providing a thermoplastic overcap comprising heat-deformable means for causing the peripheral section of a heat-sealable membrane-type closure to conform radially and circumferentially to the rim of a container body when the closure is heat sealed to the rim of the container body.

A still further major object of the present invention is providing a method of induction heat sealing an asymmetrical shape membrane-type closure to the rim of a tubular container body so that the peripheral section of the closure conforms radially and circumferentially to the rim of the tubular body.

SUMMARY OF THE INVENTION

The above recited and other objects are achieved in the present invention by providing a container subassembly comprising a membrane-type closure having an integral pull tab, a composite tubular body having a rolled top rim, and heat activatable sealant and electrical insulation disposed intermediate the peripheral section of the closure and the rim of the tubular body. The closure comprises an electrically conductive sheet which is configured to provide a disc portion and an integral pull tab. The tubular body comprises a liner of electrically conductive material having a lap seam intermediate overlapped side edge portions. The closure is sealingly secured along a circumferentially extending seam to the rim of the container so that the peripheral section of the disc portion of the closure conforms radially and circumferentially to an upwardly facing annular-shape area of the rolled rim on the tubular body. The container subassembly may further comprise an overcap comprising heat-deformable means for effecting the radial and circumferential conformation of the peripheral section of the closure to the rim of the container body. The method of induction heat sealing an asymmetrical-shape closure comprising an electrically conductive sheet to a tubular body comprising an electrically conductive liner includes the step of biasing the peripheral section of the closure towards the rim of the container body with a uniformly distributed force while adjacent portions of the electrically conductive sheet and the electrically conductive liner are simultaneously heated by induction heating means.

BRIEF DESCRIPTION OF THE DRAWINGS

While the specification concludes with claims particularly pointing out and distinctly claiming the subject matter regarded as forming the present invention, it is believed the invention will be better understood from the following description taken in connection with the accompanying drawings in which:

FIG. 1 is an exploded perspective view of a preferred container subassembly embodying the present invention.

FIG. 2 is a fragmentary perspective view of the container subassembly shown in FIG. 1.

FIG. 3 is an enlarged scale, fragmentary perspective view of the spirally wound and lap seamed liner of the container subassembly shown in FIGS. 1 and 2.

FIG. 4 is a fragmentary sectional view of the liner shown in FIG. 3 taken along line 4—4 thereof.

FIG. 5 is a fragmentary, radially outwardly looking view of the liner-seam-area of the outwardly rolled rim of the tubular container body shown in FIG. 1.

FIG. 6 is an enlarged scale bottom view of the overcap of the container subassembly shown in FIG. 1.

DESCRIPTION OF THE PREFERRED EMBODIMENT

Figure 7:
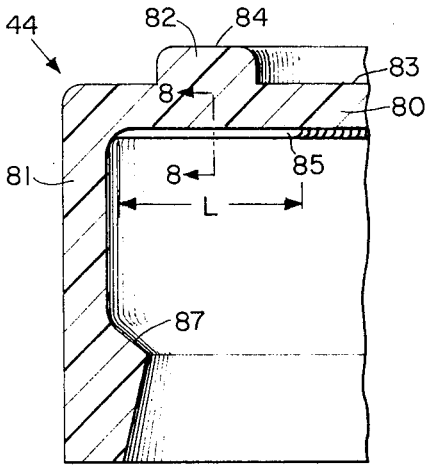
FIG. 7 is an enlarged scale, fragmentary radial sectional view of the overcap shown in FIG. 1 taken along line 7—7 thereof.

Referring now to FIGS. 1 and 2, the preferred embodiment of the present invention is a container subassembly 40 which comprises a spirally wound, composite tubular body 41, a membrane-type closure 42 having an integral pull tab 43, and an overcap 44.

Briefly, overcap 44 comprises heat-deformable means such as a multiplicity of circumferentially spaced, radially extending ribs 85 which means are heat-deformed or molded when container subassembly 40 is assembled to cause the peripheral section of closure 42 to conform radially and circumferentially to the rim of tubular body 41 regardless of minor irregularities in the rim of tubular body 41. Further, the container subassembly comprises means for induction heat sealing closure 42 to the rim of tubular body 41 and for causing the heat-deformable means to effect the above described radial and circumferential conformation of the peripheral section of closure 42 to the rim of tubular body 41.

Tubular body 41, FIG. 1, of the preferred embodiment container assembly 40 is a glue bonded, composite, spirally wound tube construction which tube, after being cut to length, has its top rim 48 rolled outwardly to form a circumferentially extending bead and has its bottom rim 49 flared to enable crimping a bottom closure thereto.

Figure 11:
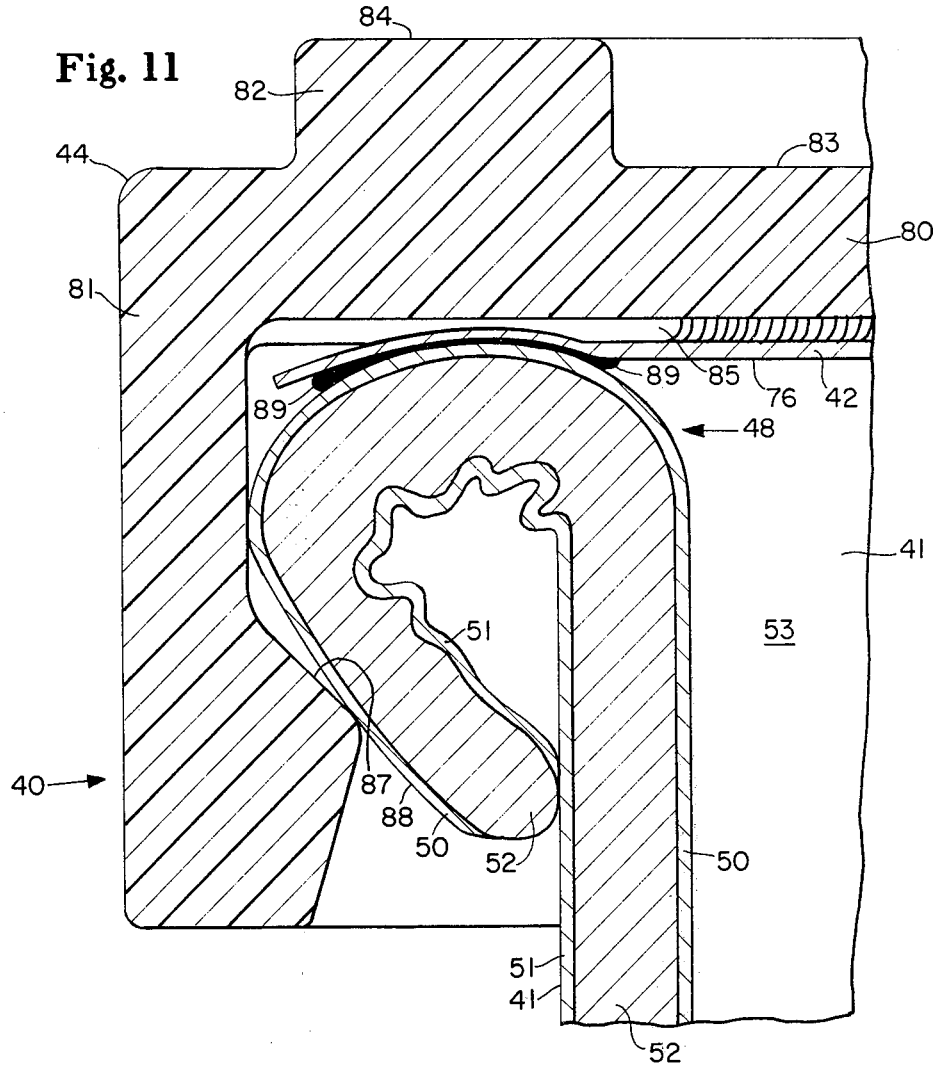
FIG. 11 is an enlarged scale radial sectional view of a top edge portion of the container subassembly shown in FIG. 2 taken along line 11—11 thereof which line extends between radially extending ribs depending from the interior surface of the overcap of the subassembly.

Referring now to FIG. 11, the multi-ply sidewall of tubular body 41, FIG. 1, is shown to comprise three major plies: an innermost ply hereinafter referred to as liner 50, an outermost ply hereinafter referred to as label 51, and a middle ply 52. In the preferred embodiment container assembly 40, FIG. 1, label 51 comprises 55 pound litho paper coated with a moisture barrier which, in turn, is printed and coated with an overprint lacquer; and the middle ply 52 is nineteen point kraft paper can board.

Liner 50, FIG. 3, comprises a web of four layer construction as shown in FIG. 4. The innermost layer 53 is a thermoplastic material which forms the radially inwardly facing portion of body 41 when the web is spirally wound and spirally lap seamed as indicated in FIG. 3. The thermoplastic material of the preferred embodiment is a 12 pound coating of Surlyn, DuPont number 1652 SR, an ionomer resin, although polypropylene and other thermoplastic materials may be used. Surlyn is a registered trademark of the E. I. DuPont de Nemours Company. The second layer 54 is aluminum foil having a preferred thickness of about thirty-five one-hundred-thousandths of an inch which is adhered to the outermost layer 56 by the third layer 55 of the construction which third layer may be a seven pound coating of low density polyethylene. The outermost layer 56 may be 25 pound machine finish natural kraft paper.

When the web from which liner 50 is spirally wound into the tubular shape shown in FIG. 3, one side edge portion 60 is doubled back so that the oppositely disposed second side edge portion 61 can be overlapped therewith with the thermoplastic innermost layer 53 of side edge portions 60, 61 in abutting relation. This enables the overlapped side edge portions 60, 61 to be heat sealed together to form a spiral lap seam or body seam 62 having a spiral inner edge 63 and a spiral outer edge 64.

As is shown in FIG. 3, spiral lap seam 62 comprises three thicknesses of the web from which the liner 50 is formed. The two extra thicknesses of liner material in spiral seam 62 precipitate a circumferentially extending hump 65, FIG. 5, in the top rim 48 of tubular body 41, which hump 65 is shown in exaggerated proportions in FIG. 5 to more clearly disclose that it causes the top rim 48 to have elevational differences around the top opening 66 of tubular body 41 as indicated in FIG. 5 by delta E; ($\Delta$ E).

As will be described more fully hereinafter, elevational differences of rim 48 around top opening 66 which differences are precipitated by lap seams and/or other aspects of making spirally wound composite tubular bodies such as 41 having outwardly rolled top rims require special attention to hermetically seal a membrane-type closure such as closure 42 to the top rims.

Figure 9:
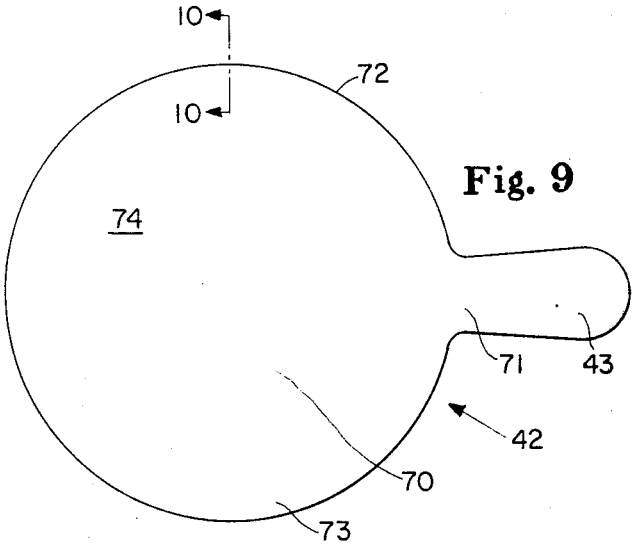
FIG. 9 is an enlarged scale top view of the membrane-type closure shown in FIG. 1 prior to folding the integral tab of the closure to the orientation shown in FIG. 1.

The membrane-type closure 42, FIG. 9, has an asymmetrical shape, and comprises a disc portion 70 and an integral radially extending tab 43 having its proximal end 71 hingedly secured to the perimeter 72 of disc portion 70. An annular-shape section of disc portion 70 which extends radially inwardly from perimeter 72 is designated peripheral section 73.

Figure 10:
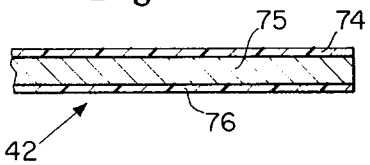
FIG. 10 is a fragmentary sectional view of the closure shown in FIG. 9 taken along line 10—10 thereof.

As shown in FIG. 10, closure 42 is a three layer construction comprising a top layer 74, a middle layer 75, and a bottom layer 76. In the preferred embodiment closure 42, middle layer 75 is an electrically conductive sheet of type 1145-0 aluminum having a nominal thickness of about three mils, top layer 74 is a one-half pound vinyl washcoat such as Adcoat 41C available from Morton Chemical Company, Chicago, Illinois, and the bottom layer is a one mil thermoplastic coating of DuPont type XBR 950 ethylene vinyl acetate. The vinyl washcoat is provided as a means for protecting the top surface of the aluminum sheet from oxidation, and the XBR 950 coating is provided on the bottom surface of the aluminum sheet to make the peripheral section 73 of closure 42 peelably heat sealable to an upwardly facing annular-shape area of the thermoplastic innermost layer 53 of liner 50 of tubular body 41 which layer 53 is disposed on the top of rim 48 by virtue of rim 48 being rolled outwardly as described hereinbefore.

Together, the portions of the XBR 950 coating and the thermoplastic layer 53 of the liner 50 of tubular body 41 comprise electrical insulation means and heat activatable sealant disposed intermediate the aluminum sheet 75 of closure 42 and the aluminum layer 54 of liner 50 whereby the peripheral section 73 of closure 42 is susceptible to being induction heat sealed to the top rim 48 of the tubular body 41 to form a hermetic circumferential seam therebetween.

Overcap 44, FIG. 1, of the preferred embodiment is made of thermoplastic material such as low density polyethylene resin type 1400 available from Gulf Oil Chemicals Co., Orange, Texas. Overcap 44, FIGS. 6 and 7, comprises a top panel 80 and an annular skirt 81 depending from the periphery of the top panel 80.

The top panel further comprises an annular-shape stacking flange 82 which extends upwardly from the exterior surface 83 of top panel 80. The stacking flange 82 has a planar, annular-shape top surface 84. The stacking flange 82 has a mean diameter substantially equal to the mean diameter of rim 48 of container body 41 so that the stacking flange 82 is superjacent the rim 48 when the overcap 44 is applied to the tubular body 41 as shown in FIGS. 2 and 11.

Figure 8:
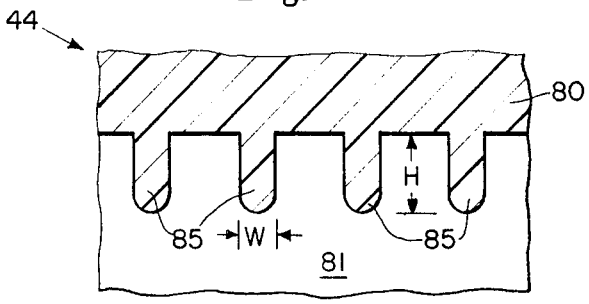
FIG. 8 is an enlarged scale fragmentary circumferential sectional view of the overcap shown in FIGS. 1, 6 and 7 taken along line 8—8 of FIG. 7.
Figure 12:
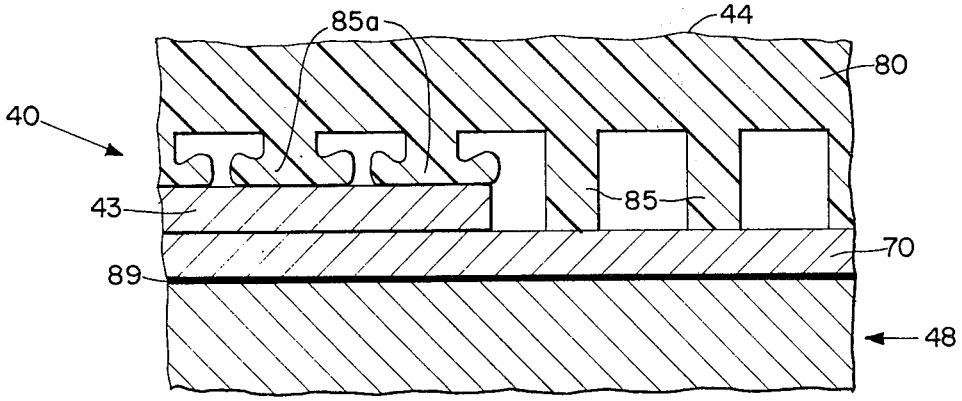
FIG. 12 is an enlarged scale circumferential sectional view of the container subassembly shown in FIG. 2 taken along line 12—12 thereof.

The top panel 83 of overcap 44 also comprises heat-deformable means such as a multiplicity of circumferentially spaced, radially extending ribs 85, FIGS. 6, 7 and 8, which depend from the interior surface of the top panel 80 of overcap 44. The ribs 85 are so disposed that they underlie the stacking flange 82 whereby they radially span the rim 48 of the tubular body 41 when the container subassembly 40 is assembled as shown in FIG. 11. FIG. 7 is a radial sectional view taken between two ribs 85 to show the radially extending profile of a rib 85 and FIG. 8 is a circumferential sectional view taken through the ribs 85 to show their transverse cross-sectional shape. Such heat deformable means as ribs 85 are provided to cause the peripheral section 73 of closure 42 to conform radially and circumferentially to the rim 48 of tubular body 41 by being heat-deformed when the container subassembly 40 is assembled as shown in FIGS. 11 and 12. In the preferred embodiment, ribs 85 have a radial length L, FIG. 7, of about one-quarter of one inch, a width W, FIG. 8, of about six-thousandths of 1 inch, are spaced circumferentially about ten-thousandths of 1 inch center-to-center, and have a height H, FIG. 8, of about eight-thousandths of 1 inch.

The annular skirt 81 of overcap 44 comprises means for cooperating with overcap engaging means provided on the tubular body 41 adjacent the top rim 48 of the body 41. In the preferred embodiment, the radially inwardly and downwardly extending shoulder 87 comprises the means for cooperating with overcap engaging means on the tubular body 41, and the radially outwardly disposed, radially inwardly and downwardly extending distal portion 88 of the outwardly turned top rim 48 of tubular body 41 comprises such overcap engaging means, all as shown in FIG. 11.

The container subassembly 40, FIGS. 1 and 2 is assembled as shown in the greatly enlarged scale radial sectional view of FIG. 11 taken along line 11—11 of FIG. 2, and as shown in the greatly enlarged scale circumferential sectional view of FIG. 12 taken along line 12—12 of FIG. 2. Briefly, the preferred method of so assembling container subassembly 40 comprises biasing the overcap 44 towards the rim 48 of the tubular body 41 while adjacent portions of the peripheral section 73 of closure 42, rim 48, and ribs 85 are simultaneously heated by induction heating means to a sufficiently high temperature to heat-deform the ribs 85 to cause them to evenly distribute the biasing force across the closure-rim interface to cause the peripheral section 73 of closure 42 to conform radially, FIG. 11, and circumferentially, FIG. 12, to rim 48 as shown, and to be hermetically sealed thereto along a circumferentially extending seam 89. By virtue of heat-deforming ribs 85 as shown in FIGS. 11 and 12, the peripheral section 73 of closure 42 can be made to so conform to rim 48 regardless of elevational differences caused by the seam 62 of the liner 50 (i.e.: hump 65, FIG. 5), or the presence of tab 43, FIG. 12.

Figure 13:
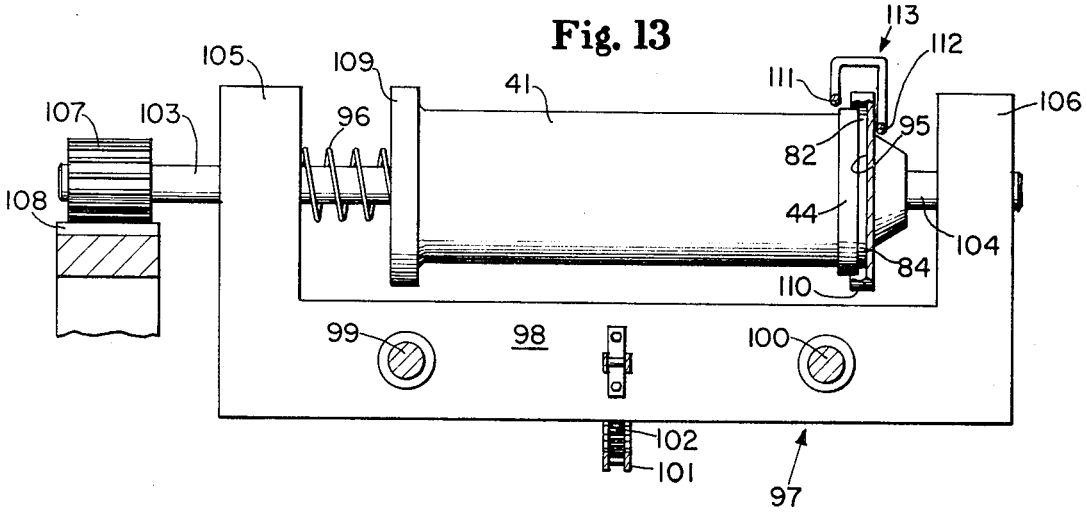
FIG. 13 is a reduced scale, end view of a portion of an apparatus for induction heat sealing the closure of the container assembly shown in FIG. 1 to the rim of the tubular body of the container assembly.
Figure 14:
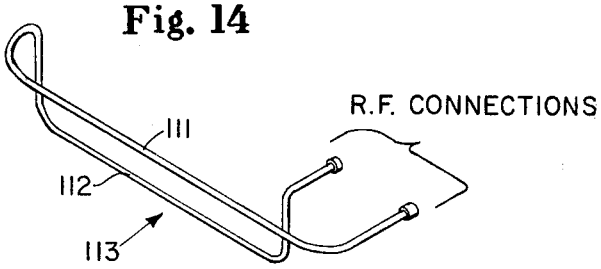
FIG. 14 is a reduced scale perspective view of the induction heating electrode of the apparatus shown in FIG. 13.

Preferably, the biasing force is applied from a planar surface 95 of a biasing device such as spring 96 incorporated in an induction heating device 97 to the planar surface 84 of overcap 44 as shown in FIG. 13 while carriage 98 is drawn along cylindrical guides 99, 100 by a chain 101 attached to the carriage 98 is drawn around a driven sprocket 102. By virtue of shafts 103, 104 being freely rotatable in the upstanding ends 105, 106 respectively of carriage 98, and by virtue of a pinion gear 107 being drivingly secured to shaft 103 and drivingly engaged with a stationary rack gear 108, a loosely assembled container subassembly 40 can be supported between cups 109, 110, and rolled past the non-contacting linear sections 111, 112 of induction heating electrode 113, FIG. 14, as the carriage 98 is moved. As shown in FIG. 13, linear section 111 of electrode 113 is disposed substantially (but not touching) tubular body 41 subjacent the top rim of the body, and the linear section 112 of electrode 113 overlies the overcap 44 and closure 42 radially inwardly from the rim of the body and extends chordally with respect to the rim. Thus, by energizing electrode 113 by a suitable RF source (not shown) adjacent portions of the electrically conductive sheet 75 of closure 42 and the electrically conductive layer 54 of liner 50 can be simultaneously induction heated whereby adjacent portions of the ribs 85 of the overcap 44, the thermoplastic coating 76 of closure 42, and the thermoplastic innermost layer 53 of liner 50 are simultaneously conductively heated. When thus heated to a sufficiently high temperature, the biasing force will precipitate the above described radial and circumferential conformation, and the hermetic circumferential seam 89 will be formed.

Ribs 85*a*, FIG. 12, illustrate the heat-deformation of the ribs which causes the biasing force to be equally distributed around the peripheral section 73 of closure 42 during the induction sealing operation described above. Were the tabs 85*a* disposed superjacent the tab 43 not so deformed, the biasing force would be concentrated in the tab area. This concentration of bias might precipitate damage to the underlying portion of rim 48 and/or reduce the bias around the remainder of the rim to a value too low to effect good sealing.

The Model 5000 R.F.C. High Frequency Generator which is available from the Radio Frequency Company, 44-46 Park Street, Medfield, Massachusetts is such a suitable RF source referred to above.

During the assembly and sealing of the preferred container subassembly described hereinabove which subassembly 40 comprises a tubular body 41 having an inner diameter of about 2⅞ inches, the R.F.C. Generator was operated at a plate current of about 13/10 amperes, a spring biasing force of about 30 pounds was applied, and the carriage was drawn past the linear sections 111, 112 of electrode 113 at about 2 feet per second. The linear sections 111, 112 of electrode 113 were approximately 12 inches long.

During such induction heat sealing as described above, and with the tab 43 of the closure 42 oriented away from the seam 62 in liner 50 of body 41 as shown in FIGS. 1 and 2, the maximum temperature achieved under the proximal end 71 of tab 43 was in the range of from about 230° to about 239° Fahrenheit while the maximum temperature achieved around the rest of the rim 48 was in the range of from about 270° to about 279° Fahrenheit.

The tensile strength of the peelable bond achieved between XBR 950 and Surlyn (registered trademark of the DuPont Company) or polypropylene is directly related to the temperature achieved during the heat sealing operation. Thus, because the maximum temperatures achieved under the proximal end 71 of tab 43 and above the body seam 62 in the rolled rim of body 41 were lower than in the remainder of the circumferential seam 89, it follows that the tensile strength of the circumferential seam 89 is smaller under the tab 43 and above the body seam 62 than in the remainder of the circumferential seam 89.

However, in similar subassemblies wherein either the electrically conductive sheet is omitted from the closure or the electrically conductive layer is omitted from the tubular body, the tensile strength of the circumferential seam is, as compared to the preferred embodiment container subassembly, inferentially, much lower as witnessed by the following examples.

When a container subassembly like the preferred embodiment but for omitting the electrically conductive sheet from the closure was subjected to the sealing conditions described hereinabove, the maximum temperature achieved intermediate the peripheral section of the closure and the rim of the tubular body was in the range of from about 120° to about 129° Fahrenheit; less than one half that achieved in the preferred embodiment.

Similarly, when a container subassembly like the preferred embodiment but for omitting the electrically conductive layer in the rim of the tubular body was subjected to the same sealing conditions, the maximum temperature achieved under the proximal end of the tab was in the range of from about 110° to about 119° Fahrenheit and the maximum temperature in the circumferential seam area spaced away from the tab and the body seam was in the range of from about 130° to about 139° Fahrenheit; also less than about one half that achieved in the preferred embodiment.

From the foregoing, it is clear that both the electrically conductive sheets in the closure 42 and the electrically conductive layer in the liner of tubular body 41 are required to enable inductively sealing those members of the subassembly together in the manner described hereinbefore. Also, by virtue of making the electrically conductive sheet and layer of aluminum, the resulting container subassembly is subject to being hermetically sealed by crimping a suitable hermetic closure to the bottom end of the tubular body. However, the electrically conductive members must be electrically insulated from each other to prevent arcing during induction heating.

Figure 15:
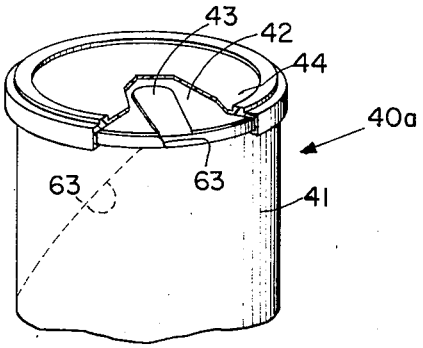
FIG. 15 is a fragmentary perspective view of an alternate container subassembly embodying the present invention.

Referring now to FIG. 15, an alternate container subassembly **40*a* is shown which comprises the same tubular body 41, closure 42, and overcap 44 as the preferred container subassembly 40, FIGS. 1 and 2. Indeed, the subassemblies 40 and 40*a* are identical but for the fact that closure 42 of subassembly 40, FIG. 2, is oriented with respect to the rim of the tubular body 41 so that the proximal end of the tab 43 is not disposed superjacent the portion of the lapped body seam 62 disposed in the rim of the tubular body in the preferred assembly 40, whereas the closure 42 of subassembly 40*a*, FIG. 15, is oriented with respect to the rim of the tubular body 41 so that the proximal end of the tab 43 is disposed superjacent the portion of the lapped body seam 62 of the tubular body 41 disposed in the rim 48 of the tubular body in the alternate container subassembly 40*a***.

As will become apparent from the following example, the circumferential seam 89, FIG. 11, of preferred embodiment container subassembly 40, FIGS. 1 and 2, has greater structural integrity than the circumferential seam in the alternate subassembly **40*a*, FIG. 15. However, because the tensile strength of the circumferential seam subjacent tab 43 of subassembly 40*a* is less than in subassembly 40, the initial pull required to begin peeling closure 42 from the tubular body 41 is commensurately less. Therefore, a container comprising subassembly 40*a* is easier to open than a container comprising subassembly 40 and for that reason more desirable for some container applications than a container comprising a subassembly 40**.

The reduced initial pull required to peel a closure from an alternate container subassembly **40*a*, FIG. 15, is inferred from the fact that when such an assembly is subjected to the same sealing conditions described in conjunction with the preferred embodiment container subassembly, the maximum temperature achieved subjacent the proximal end of the tab of the closure is in the range of from about 175° to about 179° Fahrenheit, while the maximum temperature achieved in the remaining portion of the circumferential seam is in the range of from about 270° to about 279° Fahrenheit; over twice the differential measured in the preferred container assembly 40, FIGS. 1 and 2, as set forth hereinabove. Indeed, the pull required on the tab of the closure to initiate peeling the closure from the preferred embodiment 40 is greater than two times that required for the alternate container subassembly 40*a***.

Figure 16:
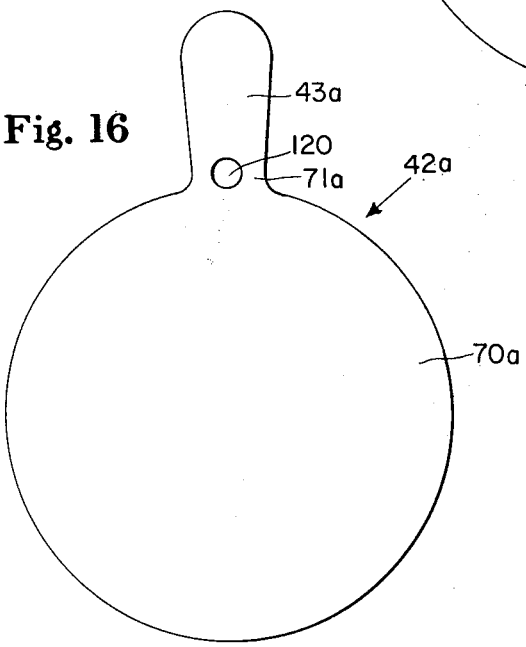
FIG. 16 is an enlarged scale top view of an alternate membrane-type closure which may be incorporated in container subassemblies embodying the present invention.

Referring now to FIG. 16, an alternate closure embodiment **42*a* is shown which has an aperture 120 disposed in the proximal end 71*a* of tab 43*a* adjacent the disc portion 70*a* of the closure. In such a closure having a three-sixteenths-inch diameter aperture in a one-half-inch wide tab, the temperature differential experienced between the area under the tab and the other portions of the circumferential seam during induction heat sealing was reduced by about 25 percent from the differential experienced in the preferred embodiment described hereinbefore. Thus, container subassemblies comprising the alternate closure 42***a* would have greater structural integrity than the preferred embodiment. It is believed that the benefit of increased structural integrity available through using alternate closures 42*a* must be balanced against the need therefore and the cost thereof.

Figure 17:
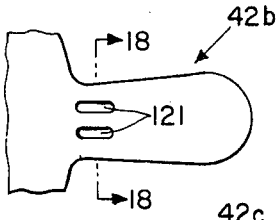
FIG. 17 is an enlarged scale, fragmentary top view of another alternate membrane-type closure which may be incorporated in container subassemblies embodying the present invention.
Figure 19:
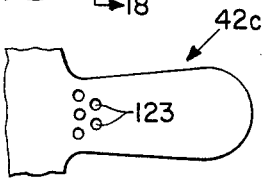
FIG. 19 is an enlarged scale, fragmentary top view of yet another alternate membrane-type closure which may be incorporated in container assemblies embodying the present invention.
Figure 18:
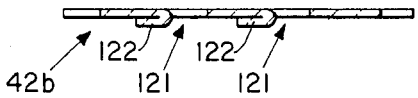
FIG. 18 is a sectional view of the alternate membrane-type closure shown in FIG. 17 taken along line 18—18 thereof.

Other alternate closure embodiments 42*b*, and 42*c* are shown in FIGS. 17 and 19 respectively. However, the elongate apertures 121 disposed in the proximal end of the tab are formed by making C-shape cuts to form flaps 122, FIG. 18, and by folding the flaps 122 as shown in FIG. 18. Such a method of providing apertures obviates scrap removal which would be required in the manufacture of alternate closures 42*a*, FIG. 16.

While particular embodiments of the present invention have been illustrated and described, it will be obvious to those skilled in the art that various changes and modifications can be made without departing from the spirit and scope of the invention and it is intended to cover, in the appended claims, all such changes and modifications that are within the scope of this invention.

What is claimed is:

1. A thermoplastic overcap for a container subassembly comprising a tubular body having an opening-defining rim and a membrane-type closure, said overcap comprising a top panel and an annular skirt depending from the periphery of said top panel, said top panel comprising heat-deformable means for causing the peripheral section of said closure to conform radially and circumferentially to said rim when said overcap is biased towards said rim by a biasing device presenting a planar surface to the exterior of said top panel while said heat-deformable means is heated to a sufficiently high temperature to effect said conformation, said heat-deformable means comprising a multiplicity of circumferentially spaced, radially extending, depending integral ribs of thermoplastic material disposed adjacent the perimeter of said top panel so that said ribs overlie said rim when said overcap is applied to said container subassembly.

2. An overcap for a container body having an opening-defining rim and overcap engaging means disposed on said container body adjacent said rim, said overcap comprising a top panel and an annular skirt depending from the periphery of said top panel, said skirt being provided with means for cooperating with said overcap engaging means to releasably interlock said overcap on said container, said top panel being provided with a multiplicity of circumferentially spaced, radially extending, depending ribs of thermoplastic material disposed adjacent the perimeter of said top panel so that said ribs overlie said rim when said overcap is interlocked with said container.

* * * * *